US008087466B2

(12) United States Patent
Iversen

(10) Patent No.: US 8,087,466 B2
(45) Date of Patent: Jan. 3, 2012

(54) CENTRALIZATION AND RUNNING TOOL AND METHOD

(75) Inventor: Arvid Iversen, Nesttun (NO)

(73) Assignee: AGR Subsea AS, Straume (NO)

( * ) Notice: Subject to any disclaimer, the term of this patent is extended or adjusted under 35 U.S.C. 154(b) by 304 days.

(21) Appl. No.: 11/884,970

(22) PCT Filed: Feb. 17, 2006

(86) PCT No.: PCT/NO2006/000068

§ 371 (c)(1),
(2), (4) Date: Jul. 30, 2008

(87) PCT Pub. No.: WO2006/088379

PCT Pub. Date: Aug. 24, 2006

(65) Prior Publication Data

US 2009/0008099 A1 Jan. 8, 2009

(30) Foreign Application Priority Data

Feb. 21, 2005 (NO) ..... 20050908

(51) Int. Cl.
*E21B 7/128* (2006.01)

(52) U.S. Cl. ..... 166/358; 166/85.3; 166/241.3; 175/7

(58) Field of Classification Search ..... 166/358, 166/85.3, 241.1–241.7, 355; 175/76, 230, 175/408, 325.1–326, 5, 7
See application file for complete search history.

(56) References Cited

U.S. PATENT DOCUMENTS 3,503,460 A * 3/1970 Gadbois ..... 175/5
3,523,578 A * 8/1970 Crain et al. ..... 166/359
3,638,721 A * 2/1972 Harrison ..... 166/351
4,137,722 A * 2/1979 Mossiossian et al. ..... 405/202
4,153,112 A * 5/1979 Luke ..... 166/355
4,200,054 A * 4/1980 Elliston ..... 114/264
4,408,932 A * 10/1983 Cowan ..... 405/227
4,445,807 A * 5/1984 Cowan ..... 405/227
4,822,212 A * 4/1989 Hall et al. ..... 405/227
5,022,472 A * 6/1991 Bailey et al. ..... 175/195

(Continued)

FOREIGN PATENT DOCUMENTS

GB 1208834 A 10/1970

(Continued)

*Primary Examiner* — Thomas Beach
*Assistant Examiner* — Matthew Buck
(74) *Attorney, Agent, or Firm* — Abelman, Frayne & Schwab

(57) ABSTRACT

The invention relates to a centralization and running tool (CTR) in a subsea installation in connection with offshore related oil and gas exploration, where the subsea installation (SCM) is arranged to be placed on the ocean bottom or a drilling template and comprises a pipe-formed body (10), at least partially open at the top and extended, arranged to receive and carry through a drill stem (12) from a drilling rig or a drilling vessel. The centralization and running tool (20) is arranged to surround the drill stem (12) and to be placed in the pipe-formed body (10), and the centralization and running tool (20) comprises, together with the drill stem (12), a rotary packing housing (22) with a number of seals (24,26) that lie against the drill stem (12), and the packing housing (22), in accordance with the movements of the drill stem (12), is arranged for radial movement to take up angular deviations of the drill stem (12). The invention also relates to a method to provide a fluid-tight seal against a drill stem (12) and against the surroundings in a subsea installation.

11 Claims, 4 Drawing Sheets

U.S. PATENT DOCUMENTS 5,395,183 A * 3/1995 Watkins ..... 405/195.1
5,647,444 A * 7/1997 Williams ..... 175/209
5,730,218 A * 3/1998 Swagerty et al. ..... 166/241.1
5,887,659 A * 3/1999 Watkins ..... 166/350
6,003,604 A * 12/1999 Wilkins ..... 166/366
6,374,914 B1 * 4/2002 Wong et al. ..... 166/241.1
6,877,565 B2 * 4/2005 Edvardsen ..... 166/352
2009/0101411 A1 * 4/2009 Hannegan et al. ..... 175/25

FOREIGN PATENT DOCUMENTS

GB 1256134 A 12/1971
WO WO 9951852 A1 10/1999

* cited by examiner

CENTRALIZATION AND RUNNING TOOL AND METHOD

The present invention relates to a centralization and running tool (CRT) in a subsea installation in connection with offshore related oil and gas exploration, where the subsea installation (SCM) is arranged to be placed on the ocean bottom or a drilling template and comprises a pipe-formed body, partially open at the top and extended, arranged to receive and carry through a drill stem from a drilling rig or a drilling vessel, with the centralization and running tool being arranged to surround the drill stem and for the placing in the pipe-formed body of the subsea installation. The invention also relates to a method to provide a fluid-tight seal against a drill stem and against the surroundings in a subsea installation.

A wellhead that is used in connection with drilling and placing of the guiding pipe is known from WO A1 99/51852, where the packing and the body seal and rotate with the drill stem. Furthermore, a rotary board on a drilling rig, which has a centralization device that moves radially to take up angular deviations in the drill stem, is known from U.S. Pat. No. 3,503,460.

The object of the present invention is to provide a solution that results in a fluid-tight seal against a drill stem in a subsea installation, preferably in connection with top hole drilling, and which at the same time is arranged to centralize the drill stem in the subsea installation.

SUMMARY OF THE INVENTION

The above mentioned objects are obtained with a centralization and running tool comprises, together with the drill stem, a rotary packing housing with a number of seals that lie against the drill stem, and that the packing housing, in accordance with the movement of the drill stem, is arranged for radial movement to take up angular deviations of the drill stem.

Preferred alternative embodiments of the centralization and running tool are arranged so that a fluid-tight seal is provided against the drill stem and against the surrounding seawater in the subsea installation.

The packing housing is preferably arranged in an outer housing which is further arranged in an assembly casing with an internal, partially ball-formed shape, where the outer housing comprises outer seals to seal against an inner, curved pipe wall in the internal, partially ball-formed assembly casing, and where the outer housing, and thus the packing housing, in accordance with the movements of the drill stem, is able to deviate from a vertical axis.

Said seals in the packing housing can be manufactured at least partially from a rubber material or a plastic material, and surround the drill stem radially, and said packing housing with seals is arranged to rotate in the outer housing together with the drill stem. The seals can be encompassed by two opposite seals that are mounted between a top and bottom lid in the packing housing, and a spacer ring can be arranged between the seals, and also a spacer ring can be arranged between the seals and associated top or bottom lid. Furthermore, seals can be arranged between the packing housing and the outer housing to seal against ingress of drilling mud and to prevent that the oil bath between the packing housing and the outer housing shall leak out.

The outer housing preferably comprises a support seal, preferably incorporating a lip-seal, for the packing housing, arranged to function as a scraper and seal. Furthermore, the outer housing can lie in a bed of grease in the internal, partially ball-formed assembly casing.

The centralization and running tool is preferably arranged in a suction and centralising module (SCM) with a pipe-formed body that comprises at least one outlet passage in the pipe wall to let through return drilling fluid to a pump module.

The invention also relates to a method to provide a fluid-tight seal against a drill stem and against the surroundings in a subsea installation as described in the independent claim 11, and is characterised by the following steps:

- to arrange a centralization and running tool around a drill stem in an area above the bottom hole assembly of the drill stem.
- to lead the drill stem through the pipe-formed body of the subsea installation for drilling of a bore hole in the ocean bottom or for guiding into an existing bore hole in the ocean bottom, and
- to mount the centralization and running tool in the pipe-formed body such that it lies against and seals against the inside of the pipe-formed body and against the drill stem, also when the drill stem rotates, with the centralization and running tool being arranged to take up radial movement caused by angular deviations of the drill stem.

Preferred alternative embodiments of the method are given in the independent claims 12 and 13. The centralization and running tool is preferably held or hangs in the drill stem over the bottom hole assembly with the help of a holding device, such as an X-over.

Furthermore, the centralization and running tool can be mounted in the subsea installation after the drill stem's bottom hole assembly and weight pipe are lead through the pipe-formed body.

BRIEF DESCRIPTION OF THE DRAWINGS

The invention shall now be described in more detail with reference to the enclosed figures, in which.

DETAILED DESCRIPTION OF THE INVENTION

Figure 1:
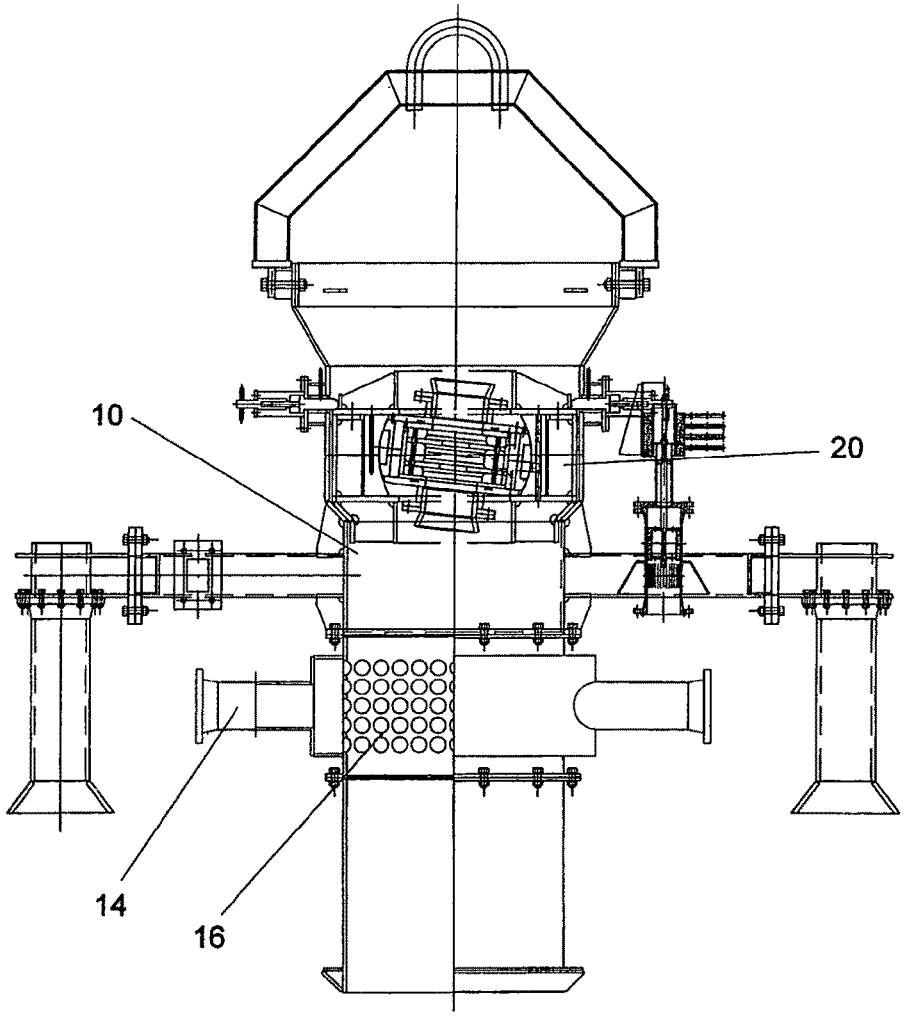
FIG. 1 shows a subsea installation (SCM) with a centralization and running tool (CRT) according to the invention.
Figure 2:
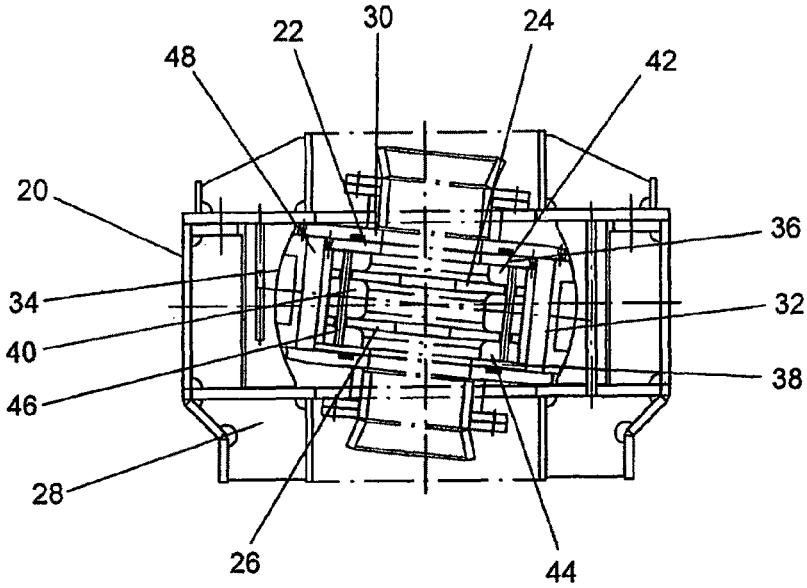
FIG. 2 shows a partial section of the centralization and running tool according to the invention.
Figure 3:
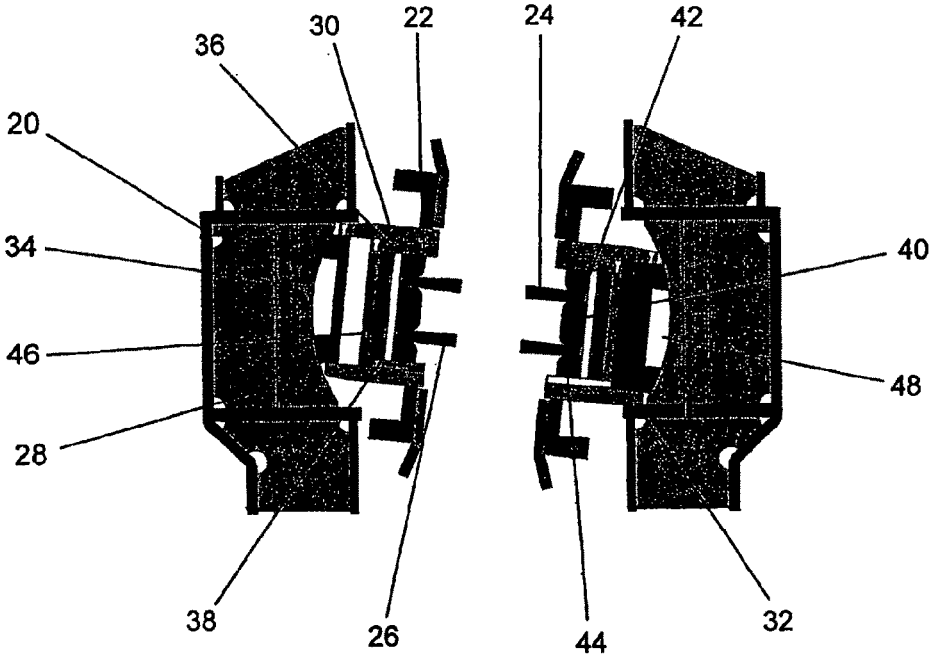
FIG. 3 shows a simplified embodiment, corresponding to FIG. 2, of a partial section of the centralization and running tool.
Figure 4:
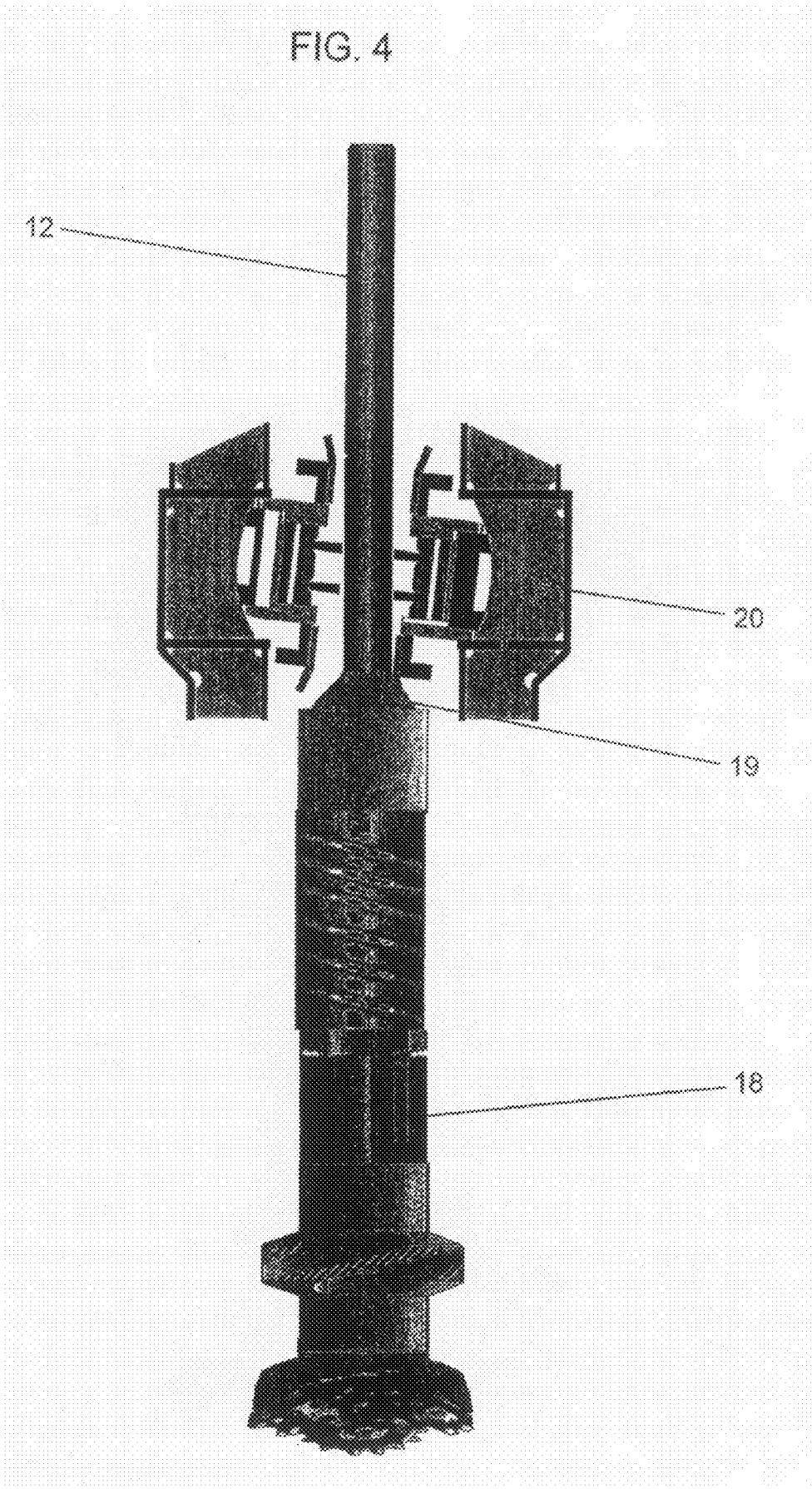
FIG. 4 shows the centralization and running tool arranged around a drill stem.
Figure 5:
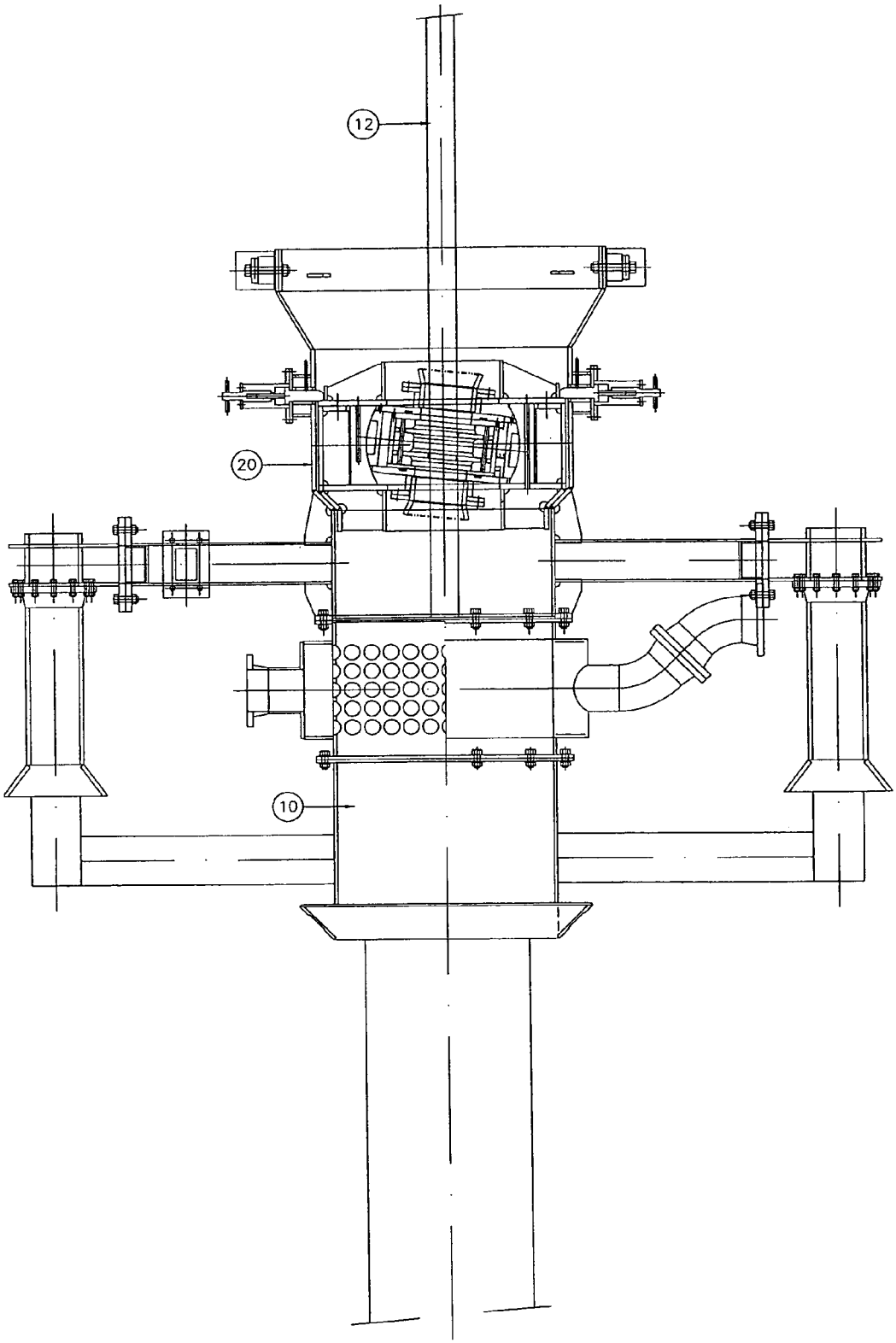
FIG. 5 shows the subsea installation (SCM) placed on the ocean bottom and with a centralization and running tool arranged around a through-going drill stem.

The invention is primarily intended for use in connection with drilling of oil and gas wells on the ocean bottom, preferably in top hole drilling. Top hole drilling is carried out at the start of drilling of a bore hole, and is normally carried out before a blow-out preventer is arranged to the wellhead and risers are arranged between the drilling rig/drilling vessel and the bore hole. However, a suction and centralising module (SCM) can also be used after top hole drilling. It shall also be noted that the present invention may also be used in connection with other subsea installations.

A subsea installation SCM can, as mentioned, comprise an extended pipe-formed body 10, open at the top and extended, which is arranged to a pipe penetrating the ocean bottom, or where the lower part of the pipe-formed body penetrates the ocean bottom, through which a drill stem 12 is led for drilling of the top hole, and where the pipe-formed body 10 can comprise at least one exit passage 14 in the pipe wall for export of return fluid from the bore hole to a pump module. To prevent a suction pipe becoming blocked when drilling in swelling clay, the SCM can be equipped with a filtration device with through openings that prevents large particles from entering the pump, which could damage or possibly block the pump. This can, for example, be achieved in that the pipe-formed body 10 comprises an inner, extended and arched perforated filtration plate 16, where the perforations in the inner filtration plate are arranged to let through, to at least one outlet passage 14, return drilling fluid containing matter such as swelling clay and stones, of a size that is smaller than the diameter of the pump inlet line or pump openings. Furthermore, the inner pipe wall of the pipe-formed body 10 and the inner perforated filtration plate 16 can provide at least one annular space that is closed at the top and/or at the bottom, where the annular space can stretch in the whole or part of the longitudinal direction of the pipe-formed body and/or in the circumference of the pipe. The perforated filtration plate 16 can preferably have a pipe shape.

Concerning other features of SCM and associated components, reference is made to the applicant's Norwegian Patent application 20035172, where the content is incorporated here by reference.

In said SCM, or corresponding subsea installation, a centralization and running tool 20, also called CRT (Centralization Running Tool) is provided to provide a fluid-tight seal against an inserted drill stem and against the surroundings, i.e. seawater. One method for placing and arrangement of the CRT in a subsea installation can comprise arranging the centralization and running tool 20 around the drill stem 12 in an area above the bottom hole assembly 18 of the drill stem, whereupon the drill stem is led through the pipe-formed body 10 to the subsea installation for drilling of a bore hole in the ocean bottom or for insertion into an existing bore hole in the ocean bottom, and thereafter to mount the centralization and running tool 20 in the pipe-formed body 10 so that it is brought up to, and seals against the inner of the pipe-formed body and against the drill stem 12, also when the drill stem rotates.

Initially, the centralization and running tool 20 is held or hangs loosely on the drill stem above the bottom hole assembly with the help of a x-over and the centralization and running tool is preferably arranged into the subsea installation after the drill stem's bottom hole assembly and weight pipe are fed through the pipe-formed body 10. After the centralization and running tool 20 has been arranged, the associated seals will be forced against the drill stem and give a fluid-tight seal around the drill stem.

Said centralization and running tool 20 (CRT) is consequently arranged to surround the drill stem 12 at the same time and to be placed in the pipe-formed body 10, where the centralization and running tool 20 comprises, together with the drill stem 12, a rotary packing housing 22 with a number of packer seals 24, 26, and where the packing housing 22, in accordance with the movement of the drill stem 12, is arranged for radial rotational movement to take up angular deviation of the drill stem. Here, movement of the drill stem means both rotational movement and the deviation of the drill stem from a vertical axis.

In a preferred embodiment, the centralization and running tool 20 briefly comprises an internal, at least partially ball-formed, assembly casing 28 for fitting in the pipe formed body 10 of the subsea installation. In the internal, ball-formed, assembly casing 28, an outer housing 30 is arranged that can rotate in the internal ball-form of the assembly casing 28 and thereby follow the axial deviation of the drill stem. Said packing housing 22 is rotary arranged in the outer housing, where said packer seals 24, 26 lie against the drill stem. The packing housing with the seals can thereby be rotated with the drill stem 12 during its rotational movement, at the same time as the packing housing 22 will also follow the deviation of the drill stem as the packing housing is mounted in the rotary outer housing 30 that can follow the axial deviation of the drill stem. The outer housing includes outer seals 32 to seal against the inner, curved pipe wall 34 and the internal, partially spherical ball-shaped surface of assembly casing 28.

Packer seals 24, 26 in the packing housing 22 are, in a preferred embodiment, manufactured at least partially from a rubber material and surround the drill stem 12 radially, and said packing housing 22 with the packer seals 24, 26 is, as mentioned, arranged to rotate in the outer housing 30, together with the drill stem 12. Alternatively, the seals can be manufactured from a plastic material such as, for example, polyurethane or the like. The main seal, i.e. the packer seals 24, 26 around the drill stem to keep the drilling mud under control, can be of the type HNBR Supernitril. In an alternative embodiment, they can have a plate thickness of, for example, 25 mm, while other dimensions can, of course, also be used. However, it shall be pointed out that the packer seals 24, 26 can be manufactured from materials other than rubber, as long as the alternative seals are capable of providing a corresponding fluid-tight seal against the drill stem.

The seals in the packing housing 22 can be comprised of two opposite, or opposing, packer seals 24, 26 that are arranged between a top and bottom lid 36, 38 in the packing housing 22, for example, with 20% press fit. A first spacer ring 40, for example a steel ring, is preferably arranged between the packer seals so that the two packer seals can have a volume where they can be displaced. Correspondingly, a second spacer ring 42, 44 can be arranged between the packer seals and associated top or bottom lid. The spacer rings can have a coarse surface so that they are able to grip the packings/seals.

The centralization and running tool 20 further comprises outer packings/seals of a mechanical type to be able to rotate the packing housing with the drill stem and to hold the packing housing perpendicular to the drill stem at all times. It is the latter that gives maximum sealing effect. Therefore, outer seals 46 can consequently be arranged between the packing housing 22 and the outer housing 30 to seal against ingress of drilling mud and to prevent that an oil bath 48 between the packing housing 22 and the outer housing 30 shall leak out. Furthermore, the outer housing 30 can comprise a support seal, preferably encompassing a lip-seal, for the packing housing 22, arranged to function as a scraper and sealant. Furthermore, the outer housing 30 can lie in a bed of grease in the internal, partially ball-formed assembly casing 28. It shall be pointed out that all packings/seals in the centralization and running tool can be manufactured from a suitable packing or sealing material, such as rubber or plastic as previously described.

It shall be pointed out that with radial movement is meant movement that deviates from a central axis of point, i.e. that the rotary packing housing 22 can be moved in an approximately forward and backward oriented movement in the centralization and running tool 20, at the same time as the packing housing can take up a tilted position, i.e. deviate from a vertical axis, such that radial movement of the drill stem 12 can be taken up. The packing housing can thus achieve movement in three planes, i.e. rotation about a vertical axis, deviation from the vertical axis and movement in a horizontal plane. Here one must see vertical and horizontal in relation to what is depicted in the figures. The centralization and running tool 20 is thereby given a fluid-tight seal against the drill stem in a subsea installation and is at the same time arranged to centralize the drill stem in the subsea installation.

The invention claimed is:

1. A centralization and running tool (CRT) for use in a subsea installation in connection with offshore oil and gas exploration, where the subsea installation is configured for placement on the ocean bottom or a drilling template and includes an elongated tubular body that is at least partially open at the top for receiving and passing a drill stem depending from a drilling rig or a drilling vessel, the CRT comprising a rotary packing housing which is mounted for rotation with the drill stem, a plurality of packer seals that contact the drill stem, said packing housing being mounted for rotational movement in response to angular deviations of the drill stem from a generally vertical axis, the CRT being configured and dimensioned to surround the drill stem and be positioned within the tubular body of the subsea installation, and to provide a fluid-tight seal against the drill stem and against surrounding seawater in the subsea installation.

2. The centralization and running tool according to claim 1, wherein the packing housing is mounted inside an outer housing, which is positioned in an assembly casing having an internal, partially spherical surface, the outer housing having outer seals to seal against the inner, arcuate surface of the assembly casing, whereby the outer housing is movable in response to the movement of the drill stem from the vertical axis.

3. The centralization and running tool according to claim 1, wherein said plurality of packer seals in the packing housing are manufactured, at least in part, from a rubber material or a plastic material.

4. The centralization and running tool according to claim 3, wherein said plurality of packer seals surround the drill stem radially, and said packing housing with said plurality of packer seals rotates in the outer housing in response to the rotation of the drill stem.

5. The centralization and running tool according to claim 4, wherein said plurality of packer seals comprise two opposing seals positioned between a top lid and bottom lid in the packing housing, and a first spacer ring is positioned between the seals, and a second spacer ring is positioned between the seals and the respective associated top lid and bottom lid.

6. The centralization and running tool according to claim 4 wherein outer seals are placed between the packing housing and the outer housing to seal against ingress of drilling mud and prevent leakage of oil from an oil bath that is located between the packing housing and the outer housing.

7. The centralization and running tool according to claim 6, wherein the outer housing lies in a bed of grease in contact with the internal, spherical surface of the assembly casing.

8. The centralization and running tool according to claim 1, which is mounted in a suction and centralising module in said tubular body, the tubular body having at least one fluid outlet passage formed in a wall.

9. A method for providing a fluid-tight seal against a drill stem and against seawater in a subsea installation in connection with offshore oil and gas exploration, where the subsea installation comprises an elongated tubular body that is at least partially open at the top, for receiving and passing a drill stem, the method comprising:

positioning a centralization and running tool around the drill stem in an area above a bottom hole assembly of the drill stem, guiding the drill stem through the tubular body of the subsea installation, for drilling a bore hole in the ocean bottom or for introduction into an existing bore hole in the ocean bottom, and placing the centralization and running tool in the tubular body in abutting and sealing relation to the inside wall of the tubular body and against the exterior surface of the drill stem to form a fluid-tight seal against the drill stem and against surrounding seawater when the drill stem rotates, the centralization and running tool being mounted for rotational movement in response to angular deviations of the drill stem from a generally vertical axis.

10. The method according to claim 9, further comprising suspending the centralization and running tool on the drill stem above the bottom hole assembly utilizing a holding device.

11. The method according to claim 10, further comprising mounting the centralization and running tool in the subsea installation after the bottom hole assembly and weight pipe of the drill stem are led through the tubular body.

* * * * *